United States Patent [19]

Altman

[11] Patent Number: 4,742,596

[45] Date of Patent: May 10, 1988

[54] TOOL FOR CLEANING AND HIGHLIGHTING AUTOMOTIVE ENGINE TIMING MARKS

[76] Inventor: William F. Altman, 6315 N. 25th Ave., Phoenix, Ariz. 85015

[21] Appl. No.: 31,453

[22] Filed: Mar. 30, 1987

[51] Int. Cl.[4] ..... A47K 7/02; A46B 9/10

[52] U.S. Cl. ..... 15/210 R; 15/105; 15/144 R; 15/147 R; 15/172; 401/88

[58] Field of Search ..... 15/144 R, 144 A, 147 R, 15/147 B, 147 C, 147 D, 148, 149, 172, 174, 210 R, 228, 105; 401/88

[56] References Cited

U.S. PATENT DOCUMENTS

| | | | |
|---|---|---|---|
| 982,597 | 1/1911 | Habig | 15/144 R |
| 2,395,245 | 2/1946 | Booharin | 15/144 A |
| 2,970,332 | 2/1961 | Zelinkoff | 15/147 R |

FOREIGN PATENT DOCUMENTS

| | | | |
|---|---|---|---|
| 2098122 | 11/1982 | United Kingdom | 15/147 R |

*Primary Examiner*—Peter Feldman

*Attorney, Agent, or Firm*—Herbert E. Haynes, Jr.

[57] ABSTRACT

A tool for treating automotive ignition timing marks includes an elongated handle, a linking member and a holding fixture for holding a stick of chalk for highlighting timing marks or a cloth for cleaning the marks. The linking member is pivotably mounted to the handle, and the holding fixture is pivotably mounted to the linking member so that the elements may be positioned in a wide variety of angular orientations with respect to one another. Tightening means are provided for locking the elements in the desired positions, enabling the device to reach otherwise inaccessible areas in the engine of an automotive vehicle.

16 Claims, 1 Drawing Sheet

TOOL FOR CLEANING AND HIGHLIGHTING AUTOMOTIVE ENGINE TIMING MARKS

BACKGROUND OF THE INVENTION

1. Field of the Invention

This invention relates in general to automotive tools and, more particularly, to an implement which allows a user to reach into an automotive engine compartment for the purpose of cleaning and/or highlighting the ignition timing marks of the engine.

2. Description of the Prior Art

In order to keep an automotive vehicle running smoothly and efficiently, it is essential that the engine's ignition timing be properly checked and adjusted at regular intervals. Ignition timing is ordinarily measured by aiming a stroboscopic timing light at timing marks provided on the crankshaft pulley or on the flywheel cover hole. A problem that automobile mechanics often encounter, however, is that because of the grease and grime which naturally accumulates over time on any automobile engine, the timing marks are covered over with dirt and thus extremely difficult, if not impossible, to see. Therefore, it becomes necessary to periodically reach into the engine compartment to clean off the timing marks with a rag, and in some instances to highlight the marks with white chalk or paint.

To the best of the inventor's knowledge, no prior art implements have even been devised which would enable a mechanic to easily reach into an automotive engine compartment for the purpose of cleaning or highlighting the ignition timing marks. Typically, the mechanic simply holds the cleaning rag or highlighting implement in his hand and reaches in toward the appropriate timing mark location with his arm. This is often very difficult and in some instance virtually impossible, since the flywheel or crankshaft pulley is always located at a difficult to reach location such as at the rear or front of the engine underneath various engine components, emissions control devices and the like. In addition, the mechanic risks burning his hand, since the engine components may be very hot. Furthermore, his hand and arm tend to get covered with grease from brushing against other dirty engine parts.

The most closely related prior art of which the inventor is aware is described in U.S. Pat. No. 2,469,050 to Mygas and U.S. Pat. No. 3,319,280 to Trachsler. Both of these patents relate to articulated holders for paint brushes, which enable the user to paint in a variety of hard-to-reach locations, and to adjust the angle of the paint brush with respect to the holder. In both cases, however, the brush holder is only pivotable at one location. Therefore, the number of configurations into which the holder can be bent is relatively limited, making the device incapable of reaching around certain obstructions such as might be found in the vicinity of the timing marks of an automotive engine. Furthermore, in both cases, the end pieces of the holders are formed as clamps specifically designed for holding paint brush handles, and would thus be unsuitable for holding cleaning rags or bits of chalk.

Therefore, a need exists for a new automotive tool which facilitates cleaning and highlighting of ignition timing marks, and which overcomes some of the problems and shortcomings of the prior art.

SUMMARY OF THE INVENTION

In accordance with the present invention, a new and improved tool is provided which enables a cleaning rag or a highlighting implement such as a stick of chalk to be extended into an automotive engine compartment for the purpose of cleaning and highlighting the ignition timing marks of the engine.

The tool comprises an elongated handle which has a mounting pad means at one end. A linking member is pivotably connected to the mounting pad means of the handle. The linking member comprises two longitudinally spaced apart apertures, including a first aperture for receiving first fastening means for pivotably joining the linking member to the mounting pad means of the handle, and a second aperture for receiving second fastening means for pivotably joining the linking member to a holding fixture. The holding fixture comprises a ring element having a diameter approximately equal to the diameter of a piece of chalk, and a pair of parallel, spaced apart flange members. Each of the flange members extends along an opposite side of the linking element and comprises an aperture which is aligned with the second aperture on the linking member for receiving the second fastening means.

In order to place the holding fixture in a particular position relative to the handle of the tool, the user may rotate the linking element any desired angular increment about the longitudinal axis of the first fastening means and also rotate the holding fixture any desired angular increment about the longitudinal axis of the second fastening means. Thus, because the tool includes two pivot points, the handle, the linking element, and the holding fixture can all be oriented in a wide variety of orientations relative to one another, which allows the holding fixture to be extended around corners and obstructions to provide access to otherwise unreachable areas. As a result, whenever it is necessary to clean off the ignition timing marks of an engine, a mechanic or other user simply needs to swivel the elements of the tool into the position needed to reach the marks, stuff a cleaning rag into the ring of the holding fixture and move the handle to and fro to brush the rag over the dirty surface. To highlight the timing marks, the user follows the same procedure, only with a stick of chalk rather than a cleaning rag being carried in the holding fixture.

Accordingly, it is an object of this invention to provide a tool for cleaning and highlighting ignition timing marks of an internal combustion engine.

Another object of the invention is to provide an articulated tool having an elongated handle, a linking element pivotably secured to the handle, and a holding fixture for holding chalk or a cleaning rag pivotably secured to the linking element.

Still another object of the invention is to provide an inexpensive, easily manufactured automotive tool for providing access to hard-to-reach areas in an automotive engine compartment.

The foregoing and other objects of the present invention, as well as the invention itself, may be more fully understood from the following description when read in conjunction with the accompanying drawings.

DETAILED DESCRIPTION OF THE INVENTION

Figure 1:
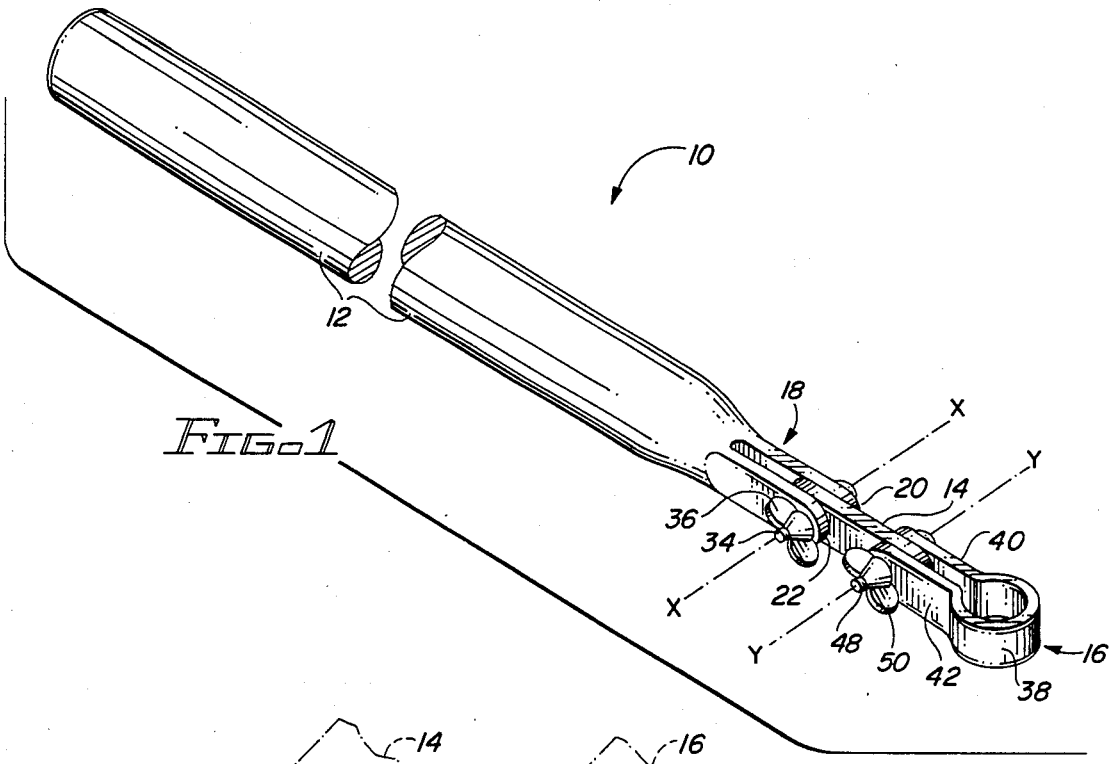
FIG. 1 is a perspective view showing the tool of the present invention.

Referring more particularly to the drawings, FIG.1 shows the cleaning and highlighting tool 10 of the present invention. The tool is comprised of three primary members: a handle 12, a linking member 14, and a holding fixture 16.

The handle 12 comprises an elongated rigid rod having a mounting pad means 18 at one end, which in this embodiment is of bifurcated configuration. The rod is preferably circular in cross-section, as it is felt that this geometry provides the most comfortable grasping surface, but any other cross-sectioned shape could be used. The rod should be of sufficient length to extend across an average-sized automobile enge. The prongs 20, 22 of the bifurcated end 18 are provided with aligned apertures 24, 26 for receiving the shank of a fastener as will be described later.

Figure 2:
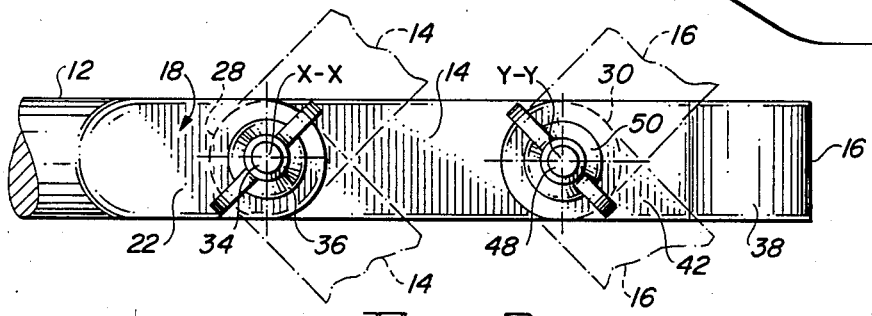
FIG. 2 is an enlarged fragmentary side view showing the pivotable connections between a first embodiment of a mounting pad means on one end of the handle, the linking element, and the holding fixture of the tool of FIG. 1.
Figure 3:
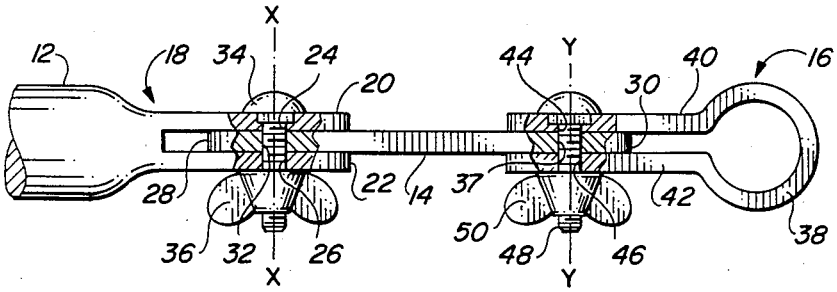
FIG. 3 is a top view of FIG. 2.

The lining member 14 comprises a bar, or strap of substantially rigid material having a pair of longitudinally spaced apart ends 28, 30. The first end 28 is received between the two prongs 20, 22 of the handle 12, and is provided with a first aperture 32 aligned with the apertures 24, 26 in the prongs. The shank of a first fastening means 34 passes through the aligned apertures 24, 26, 32, thus defining a first longitudinal axis X—X about which the linking member 14 may pivot. In addition, tightening means such as a wing nut 36 is provided on the first fastener 34 for locking the linking member 14 in any desired angular orientation with respect to the handle 12. Two of the many positions in which the member 14 may be fixed are shown in phantom in FIG. 2. In addition, a second aperture 37 is provided in the second end 30 of linking member 14 for receiving a second fastener means as will be described below.

The holding fixture 16 comprises a circumferentially compressible ring element 38 formed of a resilient material such as spring steel and having a diameter approximately equal or somewhat smaller than that of a standard-sized stick of chalk when in the mounted position shown. A pair of parallel, spaced apart flange members 40, 42 extend from the ring element 38 and when moved toward each other will circumferentially reduce the diameter of the ring element to its desired chalk-gripping size. Each of the flange members 40, 42 extends along an opposite side of the linking member 14, and comprises an aperture 44, 46 aligned with second aperture 37 in linking member 14. A second fastening means 48 extends through the three aligned apertures 37, 44, 46, to hold the ring element in the illustrated position and define a second longitudinal axis Y—Y parallel to first longitudinal axis X—X, with the holding fixture 16 being pivotable about axis Y—Y. The holding fixuture 16 may be swiveled into any desired orientation with respect to linking member 14 and locked into the desired position by means of second tightening means such as a wing nut 50 on the second fastening means 48. Again, two possible positions of the holding fixture 16 are shown in phantom in FIG. 2.

Figure 4:
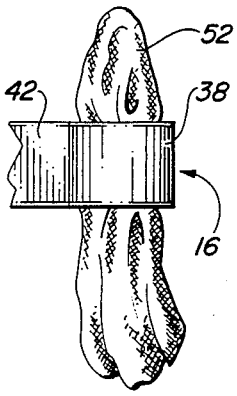
FIG. 4 is a fragmentary side view showing a rag carried in the holding fixture of the tool.
Figure 5:
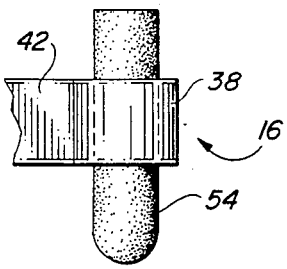
FIG. 5 is a fragmentary view showing a stick of chalk carried in the holding fixture of the tool.

In order to clean off the ignition timing marks of an engine, the elements of tool 10 may be pivoted into a configuration which provides easy access to the timing marks (not shown), and locked into this configuration by means of the wing nuts 36, 50 or other tightening means. Then a suitable cleaning rag 52, which may be saturated with a solvent, is stuffed into the ring element 38 of the holding fixture 16, as shown in FIG. 4, and handle 14 is moved to and fro in order to brush the rag 52 over the dirty surface. Likewise, to highlight the timing marks, the same procedure is used, except that in place of rag 52, a stick of chalk 54 is carried in the ring element 38 of the holding fixture, as shown in FIG. 5.

Figure 6:
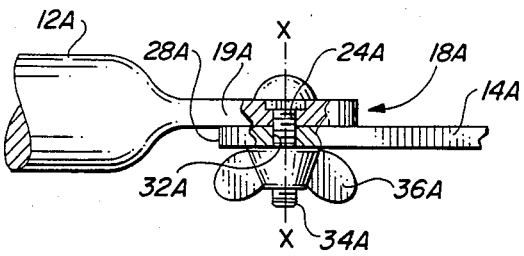
FIG. 6 is a fragmentary view similar to FIG. 3 and showing a second embodiment of the mounting pad means of the handle.

FIG. 6 shown a second embodiment of the mounting pad means, which is simpler and less expensive to manufacture than the bifurcated configuration of the first embodiment. In this embodiment, the mounting pad means 18A at the end of handle 12A is formed as a single flange 19A, rather than as a pair of prongs. The flange 19A is provided with an aperture 24A aligned with aperture 32A at the first end 28A of the linking member 14A. As in the first embodiment, a fastener 34A passes through the aligned apertures 24A, 32A and defines a longitudinal axis X—X about which linking member 14A may pivot. Tightening means 36A is carried on the shank of the fastener 34A for locking the linking member in a selected position.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A tool for holding treating implements for cleaning and highlighting the timing marks of an automotive engine, said tool comprising:

(a) elongated handle means having a mounting pad means on one end;

(b) a linking member having first and second ends with the first end being connected to the mounting pad means of said handle for pivotable rotation about a first pivot axis passing through and normal with respect to the mounting pad means of said handle and the first end of said linking member;

(c) a holding fixture means connected to said second end of said linking member and mounted for pivotable rotation about a second pivot axis parallel to said first pivot axis and passing through said second end of said linking member, said holding fixture including a ring element for holding a treating implement;

(d) first tightening means for locking said linking member in a fixed angular orientation relative to said handle means; and (e) second tightening means for locking said holding fixture in a fixed angular orientation relative to said linking member.

2. The tool of claim 1 in which said first and second tightening means comprise:

(a) bolt means, including a first bolt passing through said mounting pad means of said handle means and said first end of said linking member to define said first pivot axis, and a second bolt passing through said second end of said linking member and said holding fixture to define said second pivot axis; and (b) wing nut means, including a first wing nut threadedly carried on the shank of said first bolt for clamping said linking member to said mounting pad means of said handle means when tightened and releasing clamping pressure when loosened, and a second wing nut threadedly carried on the shank of said second bolt for clamping said holding fixture to said linking member when tightened and releasing clamping pressure when loosened.

3. The tool of claim 1, in which said mounting pad means is bifurcated to form two prongs, with the first end of said linking member being carried between said two prongs.

4. The tool of claim 1, in which said mounting pad means comprises a single apertured flange extending axially from said one end of said handle means.

5. A tool for holding treating implements for cleaning and highlighting the timing marks of an automotive engine, said tool comprising:

(a) elongated handle means including a rod of rigid material having an apertured mounting pad means on one end;

(b) a rigid linking member having two longitudinally spaced apart ends including an apertured first end connected to said mounting pad means, and an apertured second end;

(c) means passing through said apertured first end of said linking member and said apertured mounting pad means on said handle means for pivotably securing said linking member to said handle, with said means defining a first axis of rotation;

(d) a holding fixture, said holding fixture including i. a circumferentially compressible ring element for holding a treating implement, ii. a pair of parallel, spaced apart apertured flange members, each of which extends along an opposite side of said linking member;

(e) means passing through said second apertured end of said linking member and said apertured flange members of said holding fixture for pivotably securing said holding fixture to said linking member, with said means defining a second axis of rotation parallel to said first axis of rotation;

(f) first tightening means for locking said linking member in a fixed angular orientation relative to said handle means; and (g) second tightening means for locking said holding fixture in a fixed angular orientation relative to said linking member.

6. The tool of claim 5, in which said means defining said first and second axis comprise first and second threaded bolt means, respectively.

7. The tool of claim 6, in which said first and second tightening means comprise wing nut means, including a first wing nut threadedly carried on the shank of said first bolt for clamping said linking member to said mounting pad means of said handle means when tightened and releasing clamping pressure when loosened, and a second wing nut threadedly carried on the shank of said second bolt for clamping said linking member between said flange members of said holding fixture when tightened and releasing clamping pressure when loosened.

8. The tool of claim 5, in which said ring element of said holding fixture is formed of resilient material.

9. The tool of claim 8, in which said ring element is formed of spring steel.

10. The tool of claim 5, in which said mounting pad means is bifurcated to form two prongs, each of said prongs including an aperture aligned with the aperture in said apertured first and of said linking member.

11. The tool of claim 5, in which said mounting pad comprises a single flange extending axially from said one end of said handle means, said flange comprising an aperture aligned with the aperture in said apertured first end of said linking member.

12. An automotive tool comprising:

(a) elongated handle means having a mounting pad means at one end;

(b) a linking member having first and second longitudinally spaced apart ends, with the first end being connected to the mounting pad means of said handle for pivotable rotation about a first axis passing through and normal with respect to the mounting pad means of said handle and the first end of said linking member;

(c) a holding fixture means connected to said second end of said linking member and mounted for pivotable rotation about a second axis parallel to said first axis and passing through said second end of said linking member, and holding fixture including a circumferentially compressible cylindrical ring element;

(d) a treating implement carried in said ring element for improving the visibility of ignition timing marks in an automotive engine;

(e) first adjustable tightening means for releasably locking said linking member in a fixed angular orientation relative to said handle means; and (f) second adjustable tightening means for releasably locking said holding fixture in a fixed angular orientation relative to said linking element.

13. The automotive tool of claim 12, in which said treating implement comprises a stick of chalk for highlighting said ignition timing marks.

14. The automotive tool of claim 12, in which said treating implement comprises a cloth for wiping dirt off said ignition timing marks.

15. The automotive tool of claim 12, in which said mounting pad means is bifurcated to form two prongs, with the first end of said linking member being carried between said two prongs.

16. The automotive tool of claim 12, in which said mounting pad means comprises a single apertured flange extending axially from said one end of said handle means.

* * * * *